US011025011B1

(12) United States Patent
Daughtry

(10) Patent No.: US 11,025,011 B1
(45) Date of Patent: Jun. 1, 2021

(54) RF CONNECTOR WITH V-GROOVED EMI SEALING INTERFACE

(71) Applicant: Genesis Technology USA, Inc., Lawrenceville, GA (US)

(72) Inventor: Earl Anthony Daughtry, Lawrenceville, GA (US)

(73) Assignee: Genesis Technology USA, Inc., Lawrenceville, GA (US)

( * ) Notice: Subject to any disclaimer, the term of this patent is extended or adjusted under 35 U.S.C. 154(b) by 0 days.

(21) Appl. No.: 16/802,153

(22) Filed: Feb. 26, 2020

(51) Int. Cl.
*H01R 13/658* (2011.01)
*H01R 24/50* (2011.01)
*H01R 103/00* (2006.01)

(52) U.S. Cl.
CPC ..... *H01R 13/658* (2013.01); *H01R 24/50* (2013.01); *H01R 2103/00* (2013.01)

(58) Field of Classification Search
None
See application file for complete search history.

(56) References Cited

U.S. PATENT DOCUMENTS

| | | | | |
|---|---|---|---|---|
| 5,215,470 | A * | 6/1993 | Henry | H01R 13/5045 439/63 |
| 9,761,972 | B2 * | 9/2017 | Beucler | H05K 1/0237 |
| 10,749,281 | B1 * | 8/2020 | Vallely | H01R 9/05 |
| 2010/0022123 | A1 * | 1/2010 | Zhang | H01R 13/42 439/578 |
| 2015/0222061 | A1 * | 8/2015 | Kaneko | H01R 24/50 439/581 |

* cited by examiner

*Primary Examiner* — Oscar C Jimenez
(74) *Attorney, Agent, or Firm* — The Van Winkle Law Firm; Charles L. Warner

(57) ABSTRACT

An electrical connector (10) has a body, a center conductor (55), and an insulator (75). The body has a receptacle end (30), a board end (25) having a rear plane (85) and a plurality of fastener holes for a plurality of fasteners (50), a void extending from the receptacle end to the board end, and a grounding feature (70) substantially surrounding the void at the board end, the grounding feature extending beyond the rear plane and being approximately in the shape of a "V" having a base which points away from the rear plane. The center conductor is in the void and extends from the receptacle end to beyond the rear plane of the board end. The insulator is in the void and substantially surrounds the center conductor in the void.

16 Claims, 4 Drawing Sheets

RF CONNECTOR WITH V-GROOVED EMI SEALING INTERFACE

BACKGROUND

Many environments today are experiencing higher and higher levels of background radio frequency (RF) radiation due to, for example, cellular systems, microwave ovens, and computers. These signals have the potential to disrupt the operation of some devices. Also, it is important that devices do not radiate RF signals which may interfere with the operation of other devices. Therefore, higher and higher levels of RF shielding are needed to provide immunity from interfering services and systems, including increased levels of RF electromagnetic shielding on printed circuit boards (PCB), and including increased shielding at input and output connectors, such as the RF input/output (I/O) connectors on a PCB.

SUMMARY OF THE INVENTION

An electrical connector body has a receptacle end, a board end having a rear plane, a void extending from the receptacle end to the board end, a grounding feature substantially surrounding the void at the board end, the grounding feature extending beyond the rear plane and being approximately in the shape of a "V" having a base which points away from the rear plane, and a plurality of fastener holes in the board end.

An electrical connector has a body, a center conductor, and an insulator. The body has a receptacle end, a board end having a rear plane and a plurality of fastener holes, a void extending from the receptacle end to the board end, and a grounding feature substantially surrounding the void at the board end, the grounding feature extending beyond the rear plane and being approximately in the shape of a "V" having a base which points away from the rear plane. The center conductor is in the void and extends from the receptacle end to beyond the rear plane of the board end. The insulator is in the void and substantially surrounds the center conductor in the void.

DETAILED DESCRIPTION OF THE INVENTION

Figure 1:
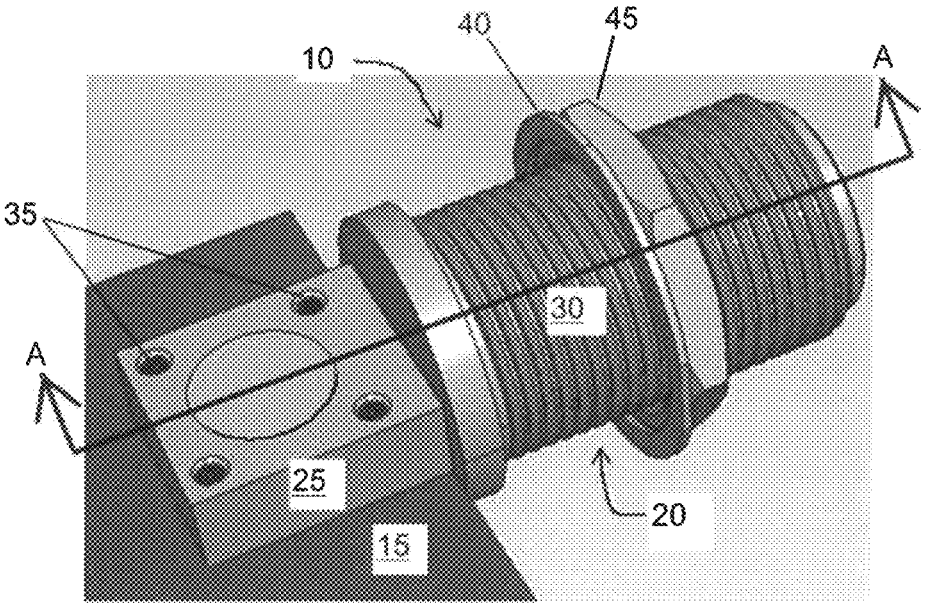
FIG. 1 is an illustration of an electrical connector, mounted on an edge of a ground plane side of a PCB.

FIG. 1 is an illustration of an electrical connector 10, mounted on an edge of a PCB 15. For convenience of illustration, ground planes, board shielding, wiring traces, and circuit components are not shown. The electrical connector 10 has a body 20 having a board end 25 and a receptacle end 30. The board end 25 has a plurality of fastener holes 35 whereby fasteners secure the electrical connector 10 to the PCB 15. In an embodiment, the receptacle end 30 is a threaded barrel connector, such as an F-connector or an N-connector, and a washer 40 and a retaining nut 45 are also shown. In another embodiment, the receptacle end 30 is a smooth barrel connector, such as an SMB connector.

Figure 2:
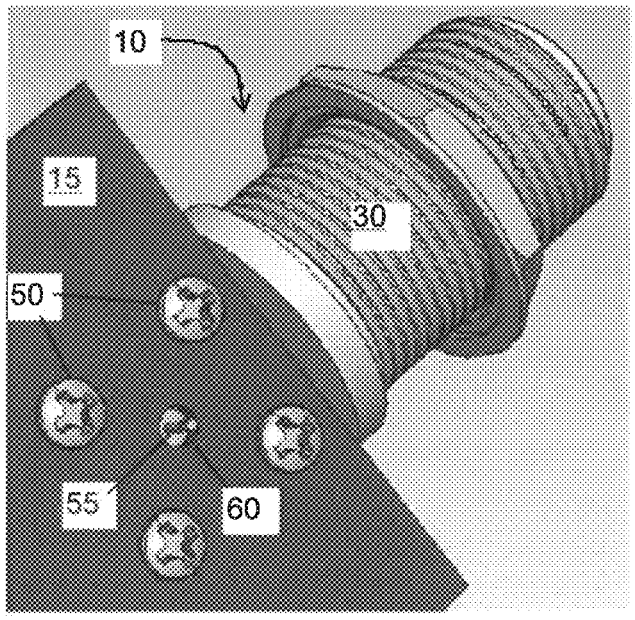
FIG. 2 is an illustration of the electrical connector, from the bottom side of the printed circuit board, showing the fasteners securing the electrical connector to the PCB.

FIG. 2 is an illustration of the electrical connector 10, from the bottom side of the printed circuit board 15, showing the fasteners 50 securing the electrical connector 10 to the PCB 15. In this view, the fasteners 50 are threaded metal screws which screw into the fastener holes 35, so the fastener holes are threaded holes. Also shown is a center conductor 55 of the electrical connector 10 protruding through a hole 60 in the PCB 15. In the embodiment shown, the connector 10 is a right-angle connector. That is, the center connector 55 makes a right angle turn between the receptacle end 30 and the board end 25. The grounding feature disclosed herein may also be used with a straight-through connector where center connector 55 is essentially straight between the receptacle end 30 and the board end 25, such as a vertical connector which stands upright on the PCB 15.

Figure 3:
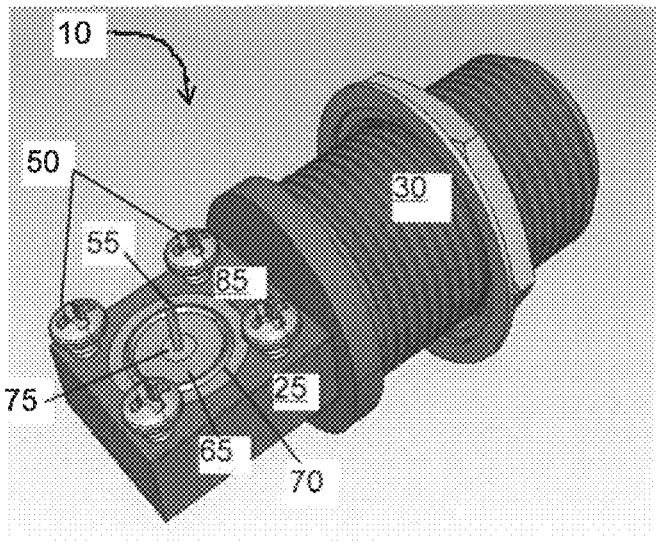
FIG. 3 is an illustration of the underside of the electrical connector, showing the grounding feature.

FIG. 3 is an illustration of the underside of the electrical connector 10, showing the grounding feature 70. The grounding feature 70 is in the shape of an approximately "V"-shaped ridge, with the base of the "V" extending away from the board end 25. In one embodiment the base of the "V" is slightly truncated so that the base of the "V" is flat. In another embodiment the base of the "V" is sharp, that is, little or no truncation. The grounding feature 70 may be manufactured as part of the board end 25, or manufactured as part of an insert 65 which is then inserted into the board end 25. The grounding feature 70 is preferably a continuous ring with no gaps. In an alternative embodiment, the grounding feature 70 may have, or result in, one or more gaps which are much smaller than the wavelength of any frequency of interest.

Also shown is an insulator 75 surrounding the center conductor 55. The center conductor 55 extends from a point outside the board end 25, through the electrical connector 10, and to the receptacle end 30. The insulator 75 extends from the board end 25, through the electrical connector 10, and at least partially into the receptacle end 30.

The side of the board end 25 which contacts the PCB 15 may be considered as defining a rear plane 85, with the grounding feature 70 extending beyond the rear plane 85.

Figure 4:
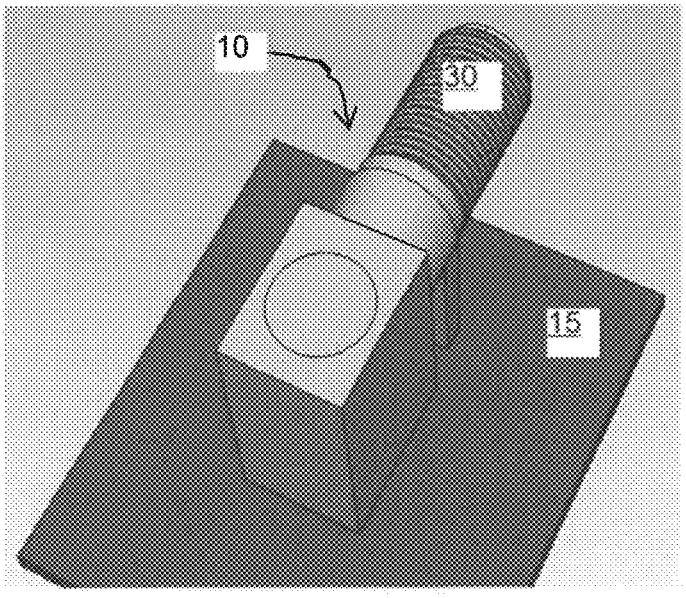
FIG. 4 is an illustration of another embodiment of the electrical connector, mounted away from the edge of the printed circuit board.

FIG. 4 is an illustration of another embodiment of the electrical connector 10, having a higher profile, so that the barrel of the receptacle end 30 is positioned above and away from the edge of the printed circuit board 15.

Figure 5:
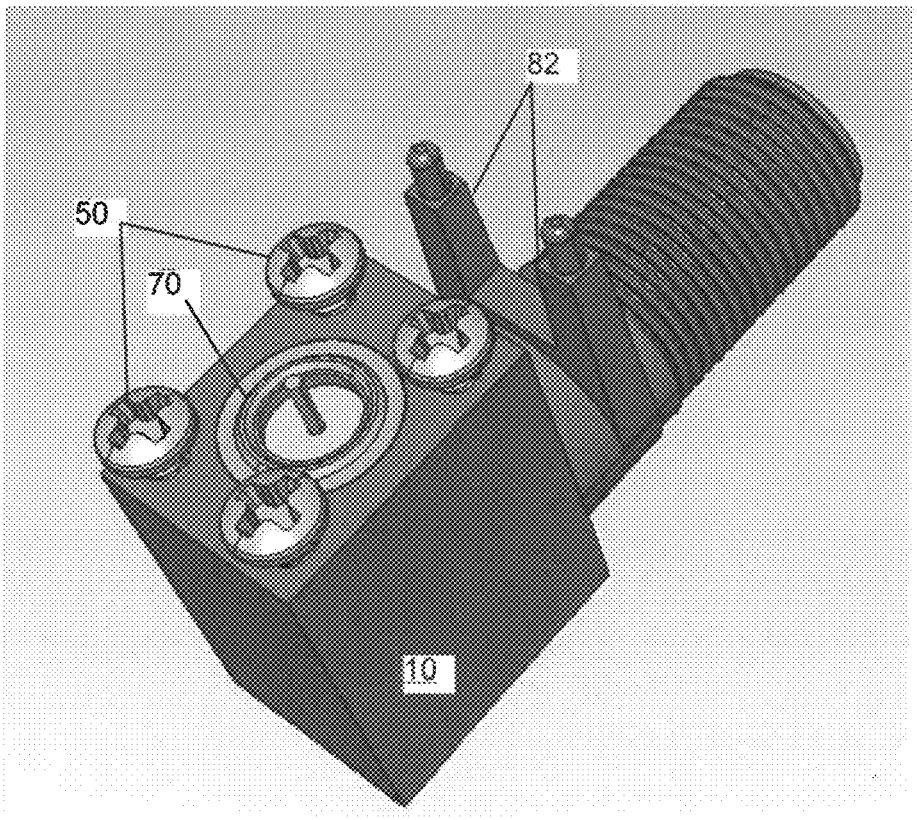
FIG. 5 is an illustration of the underside of the electrical connector of FIG. 4, showing the grounding feature.

FIG. 5 is an illustration of the underside of the electrical connector 10 of FIG. 4, showing the grounding feature 70 and standoff/mounting posts 82.

Figure 6:
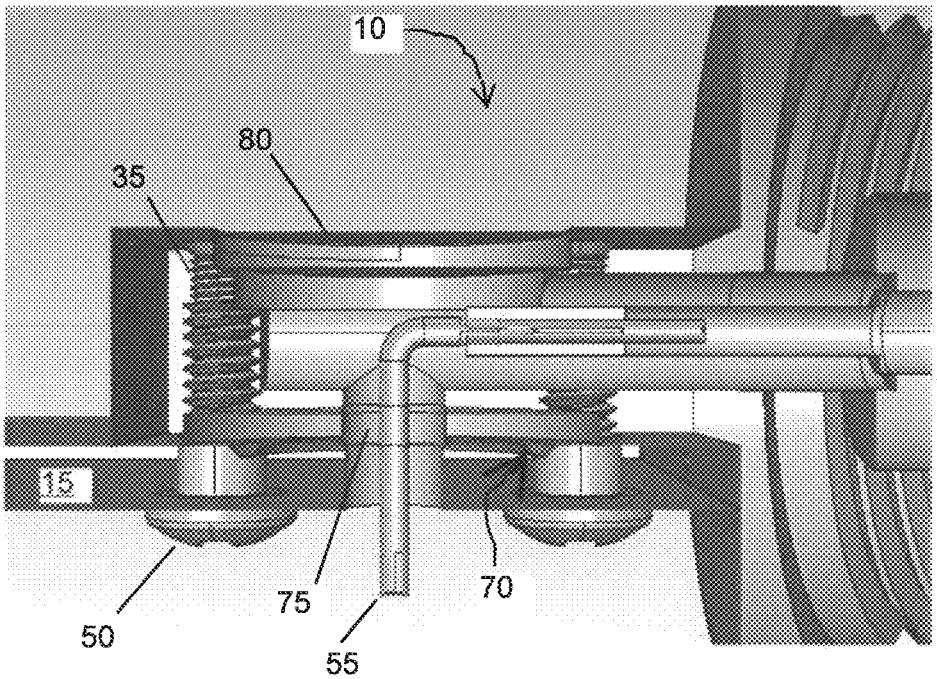
FIG. 6 is an illustration of a cross section view along line A-A of the electrical connector of FIG. 1.

FIG. 6 is an illustration of a cross section view along line A-A of the electrical connector 10 of FIG. 1 showing the center conductor 55, the insulator 75, fasteners 50, fastener hole 35, the PCB 15, and a cap 80 used to allow access to the interior of the connector 10 during assembly of the connector 10. FIG. 6 also illustrates that the center conductor 55 and/or the insulator 75 may be two or more distinct components which are connected together in the connector body 20 during assembly of the connector 10.

Figure 7A:
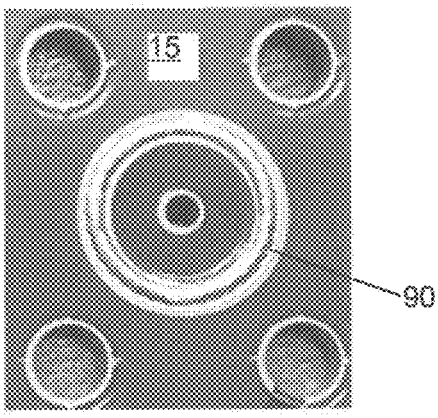
FIG. 7A is a photograph of a PCB with a metallic ring for accepting the grounding feature.

FIG. 7A is a photograph of a PCB 15 with a metallic ring 90 for accepting the grounding feature 70. The metallic ring 90 may be, for example, an Organic Solderability Preservative (OSP) finish, Electroless Nickel with Immersion Gold (ENIG) finish, or a HASL (Hot-Air Solder Levelled) finish. If a gold plated (ENIG) or HASL PCB finish is used with the metallic ring 90, no additional treatment of the PCB is necessary for use with the grounding feature 70.

Figure 7B:
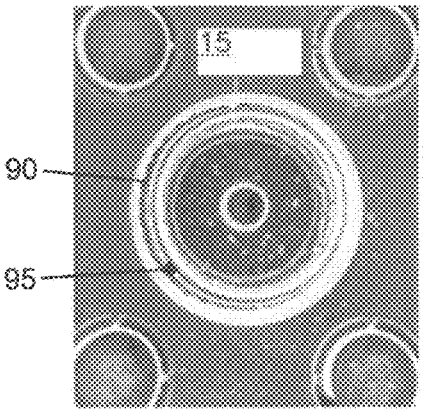
FIG. 7B is a photograph of the PCB showing the metallic ring after a connector with the grounding feature has been applied and removed.

FIG. 7B is a photograph of the PCB 15 showing the metallic ring 90 after a connector 10 with the grounding feature 70 has been attached and removed. The metallic ring 90 now bears an impression 95 (groove) of the grounding feature 70. Note that the impression 95 goes completely around the metallic ring 90, with no or minimal gaps, thereby assuring a closed EMI seal against any RF leakage to or from the junction of the connector 10 and the PCB 15. As a result, no other EMI shielding or gasketing is needed.

The V-shaped nature of the grounding feature 70 creates a seal by creating a V-shaped impression 95 into the metallic ring 90 by the force exerted by the fasteners 50 on the connector 10. The fasteners 50 force the grounding feature 70 into the metallic ring 90, thereby creating the impression 95 in the metallic ring 90. Preferably, at least four fasteners 50 are used, although acceptable results may be obtained in some cases with only two or three strategically placed fasteners 50.

Figure 8A:
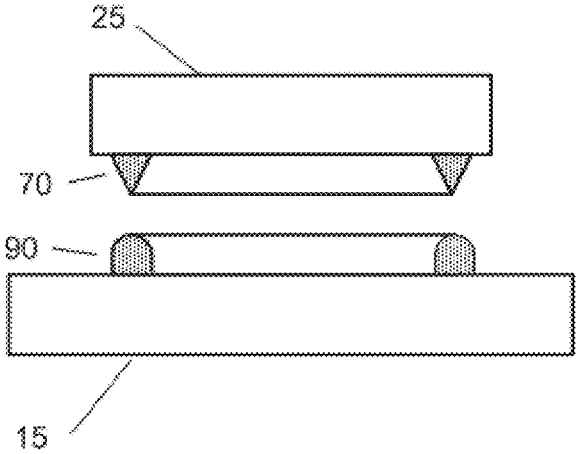
FIGS. 8A and 8B are partial side view illustrations of the connector and the PCB before and after the connector and the PCB are mated.
Figure 8B:
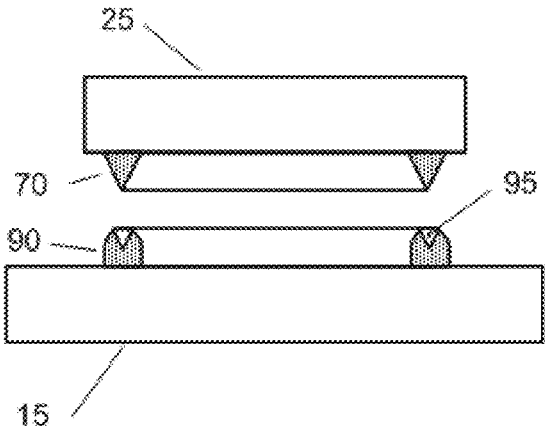

FIGS. 8A and 8B are partial side view illustrations of the connector and the PCB before and after the connector and the PCB are mated. The board end 25 of the connector 10 has the grounding feature 70 in the shape of an approximately "V"-shaped ridge, with the base of the "V" extending away from the board end 25. The PCB 15 has the metallic ring 90 for accepting the grounding feature 70. After the connector and the PCB are mated the metallic ring 90 has the approximately "V"-shaped impression 95 caused by the grounding feature 70. Shading is for clarity of illustration.

Although a right-angle mount connector 10 has been shown, the grounding feature may also be used with a straight-through connector, such as a vertical connector which stands upright on the PCB 15.

Also, the grounding feature 70 may be used in any application where an RF connector interfaces to a PCB and a high level of EMI shielding from external RF signals is required. Although F-type, N-type, and SMB type RF connectors 10 has been illustrated, the grounding feature 70 can be used with other types of connectors where fasteners 50 are used to secure the connector 10 to a PCB 15.

The grounding feature 70 surpasses previous methods of shielding an RF connector, such as, for example: the use of an RF shield over the connector which requires installation, securing, and soldering of an additional component; seam-soldering the entire RF connector to the PCB, which renders repairs difficult; grounding clips, which are not as effective due to the gaps between the clips; and the use of EMI gasket material.

Unless otherwise defined, all terms (including technical and scientific terms) used herein have the same meaning as commonly understood by one of ordinary skill in the art to which this subject matter belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. For brevity and/or clarity, well-known functions or constructions may not be described in detail herein.

The term "exemplary" is used herein to mean serving as an example, instance, or illustration. Any aspect or design described herein as "exemplary" is not necessarily to be construed as preferred or advantageous over other aspects or designs. Similarly, examples are provided herein solely for purposes of clarity and understanding and are not meant to limit the subject innovation or portion thereof in any manner.

The terms "for example" and "such as" mean "by way of example and not of limitation." The subject matter described herein is provided by way of illustration for the purposes of teaching, suggesting, and describing, and not limiting or restricting. Combinations and alternatives to the illustrated embodiments are contemplated, described herein, and set forth in the claims.

For convenience of discussion herein, when there is more than one of a component, that component may be referred to herein either collectively or singularly by the singular reference numeral unless expressly stated otherwise or the context clearly indicates otherwise. For example, components N (plural) or component N (singular) may be used unless a specific component is intended. Also, the singular forms "a," "an," and "the" are intended to include the plural forms as well, unless expressly stated otherwise or the context indicates otherwise.

It will be further understood that the terms "includes," "comprises," "including," and/or "comprising" specify the presence of stated features, steps, operations, elements, and/or components, but do not preclude the presence or addition of one or more other features, steps, operations, elements, components, and/or groups thereof unless explicitly stated otherwise or the context clearly requires otherwise. The terms "includes," "has" or "having" or variations in form thereof are intended to be inclusive in a manner similar to the term "comprises" as that term is interpreted when employed as a transitional word in a claim.

It will be understood that when a component is referred to as being "connected" or "coupled" to another component, it can be directly connected or coupled, or coupled by one or more intervening components, unless expressly stated otherwise or the context clearly indicates otherwise.

The term "and/or" includes any and all combinations of one or more of the associated listed items. As used herein, phrases such as "between X and Y" and "between about X and Y" should be interpreted to include X and Y unless expressly stated otherwise or the context clearly indicates otherwise.

Terms such as "about", "approximately", and "substantially" are relative terms and indicate that, although two values may not be identical, their difference is such that the apparatus or method still provides the indicated or desired result, or that the operation of a device or method is not adversely affected to the point where it cannot perform its intended purpose. As an example, and not as a limitation, if a height of "approximately X inches" is recited, a lower or higher height is still "approximately X inches" if the desired function can still be performed or the desired result can still be achieved.

While the terms vertical, horizontal, upper, lower, bottom, top, and the like may be used herein, it is to be understood that these terms are used for ease in referencing the drawing and, unless otherwise indicated or required by context, does not denote a required orientation.

The different advantages and benefits disclosed and/or provided by the implementation(s) disclosed herein may be used individually or in combination with one, some or possibly even all of the other benefits. Furthermore, not every implementation, nor every component of an implementation, is necessarily required to obtain, or necessarily required to provide, one or more of the advantages and benefits of the implementation.

Conditional language, such as, among others, "can", "could", "might", or "may", unless specifically stated otherwise, or otherwise understood within the context as used, is generally intended to convey that certain embodiments preferably or optionally include certain features, elements and/or steps, while some other embodiments optionally do not include those certain features, elements and/or steps. Thus, such conditional language indicates, in general, that those features, elements and/or step may not be required for every implementation or embodiment.

The subject matter described herein is provided by way of illustration only and should not be construed as limiting the nature and scope of the subject invention. While examples of aspects of the subject invention have been provided above, it is not possible to describe every conceivable combination of components or methodologies for implementing the subject invention, and one of ordinary skill in the art may recognize that further combinations and permutations of the subject invention are possible. Furthermore, the subject invention is not necessarily limited to implementations that solve any or all disadvantages which may have been noted in any part of this disclosure. Various modifications and changes may be made to the subject invention described herein without following, or departing from the spirit and scope of, the exemplary embodiments and applications illustrated and described herein. Although the subject matter presented herein has been described in language specific to components used therein, it is to be understood that the subject invention is not necessarily limited to the specific components or characteristics thereof described herein; rather, the specific components and characteristics thereof are disclosed as example forms of implementing the subject invention.

Accordingly, the disclosed subject matter is intended to embrace all alterations, modifications, and variations, that fall within the scope and spirit of any claims that are written, or may be written, for the subject invention.

What is claimed is:

1. An electrical connector body comprising:

a receptacle end;

a board end having a rear plane;

a void extending from the receptacle end to the board end;

an EMI sealing feature substantially surrounding the void at the board end, the EMI sealing feature being conductive, extending beyond the rear plane and being approximately in the shape of a "V" having a base which points away from the rear plane; and a plurality of fastener holes in the board end.

2. The electrical connector body of claim 1 wherein the shape is a "V" having a truncated base.

3. The electrical connector body of claim 1 wherein the EMI sealing feature is a ridge.

4. The electrical connector body of claim 1 wherein the EMI sealing feature is spaced away from, and surrounds, the void.

5. The electrical connector body of claim 1 wherein the receptacle end is at a right angle to the board end.

6. The electrical connector body of claim 1 wherein the body further comprises at least one stand-off post.

7. An electrical connector comprising:

a body having a receptacle end, a board end having a rear plane and a plurality of fastener holes, a void extending from the receptacle end to the board end, and an EMI sealing feature substantially surrounding the void at the board end, the EMI sealing feature extending beyond the rear plane, being conductive, and being approximately in the shape of a "V" having a base which points away from the rear plane;

a center conductor, in the void, and extending from the receptacle end to beyond the rear plane of the board end; and an insulator, in the void, and substantially surrounding the center conductor in the void.

8. The electrical connector of claim 7 wherein the shape is a "V" having a truncated base.

9. The electrical connector of claim 7 wherein the EMI sealing feature is a ridge.

10. The electrical connector of claim 7 wherein the EMI sealing feature is spaced away from, and surrounds, the void.

11. The electrical connector of claim 7 wherein the receptacle end is at a right angle to the board end.

12. The electrical connector of claim 7 wherein the body further comprises at least one stand-off post.

13. The electrical connector of claim 7 wherein the center conductor comprises a plurality of components.

14. The electrical connector of claim 7 wherein the insulator comprises a plurality of components.

15. An electrical connector system, comprising:

a connector comprising:

a body having a receptacle end, a board end having a rear plane and a plurality of fastener holes, a void extending from the receptacle end to the board end, and an EMI sealing feature substantially surrounding the void at the board end, the EMI sealing feature extending beyond the rear plane, being conductive, and being approximately in the shape of a "V" having a base which points away from the rear plane;

a center conductor, in the void, and extending from the receptacle end to beyond the rear plane of the board end; and an insulator, in the void, and substantially surrounding the center conductor in the void; and a printed circuit board (PCB), the PCB having:

a hole for accepting the center conductor; and a metallic ring for accepting the EMI sealing feature, wherein the EMI sealing feature creates an approximately V-shaped impression in the metallic ring.

16. The electrical connector system of claim 15, wherein the metallic ring is one of: an Organic Solderability Preservative (OSP) finish; Electroless Nickel with Immersion Gold (ENIG) finish; or a HASL (Hot-Air Solder Levelled) finish.

* * * * *